US005551739A

United States Patent [19]

Solis

[11] Patent Number: 5,551,739

[45] Date of Patent: Sep. 3, 1996

[54] CHAIN LOCK FOR TRAILER DOORS OR MOBILE HOME DOORS

[76] Inventor: Avis A. Solis, P.O. Box 12512, Wichita, Kans. 67277

[21] Appl. No.: 417,105

[22] Filed: Apr. 5, 1995

[51] Int. Cl.[6] ..... E05C 17/36

[52] U.S. Cl. ..... 292/264

[58] Field of Search ..... 292/264, 289, 292/292; 70/93

[56] References Cited

U.S. PATENT DOCUMENTS

| | | | |
|---|---|---|---|
| 3,401,969 | 9/1968 | Neel . | |
| 3,514,143 | 5/1970 | Schaefer . | |
| 3,667,794 | 6/1972 | Lentz, Jr. | 292/264 |
| 3,936,085 | 2/1976 | Long . | |
| 4,027,908 | 6/1977 | Crepinsek | 70/93 X |
| 4,296,957 | 10/1981 | Belles | 292/264 |
| 4,623,180 | 11/1986 | Zimmerly . | |
| 4,889,372 | 12/1989 | Dege et al. . | |

FOREIGN PATENT DOCUMENTS

| | | | |
|---|---|---|---|
| 683658 | 4/1964 | Canada | 292/264 |

*Primary Examiner*—Rodney M. Lindsey

*Attorney, Agent, or Firm*—Robert L. Daub, Esq; Daub Legal Services, P.A.

[57] ABSTRACT

A chain lock for securing doors having a chain connected to a first mounting member at one end and to a locking member at the other end, the locking member for inserting through an eye defined on a second mounting member attached to the door.

1 Claim, 1 Drawing Sheet

FIG. 1
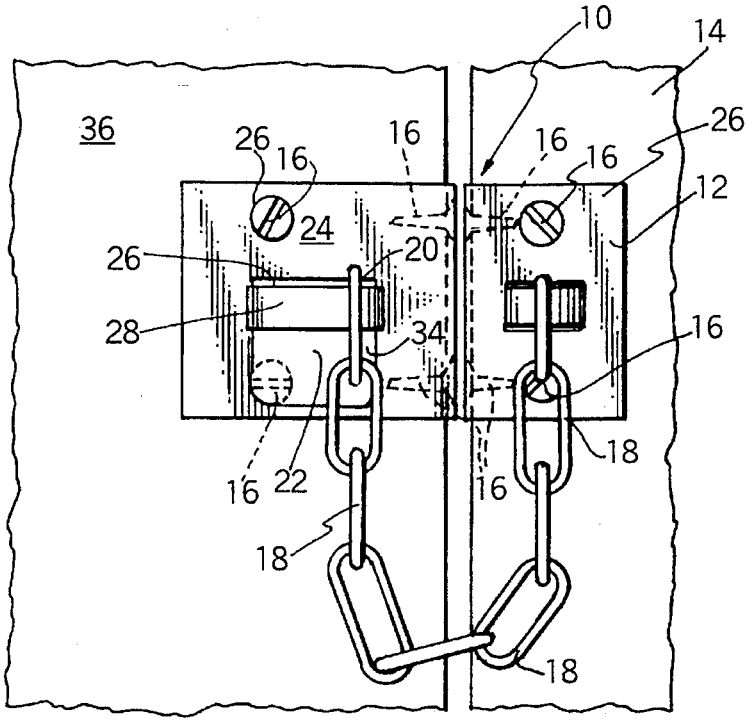
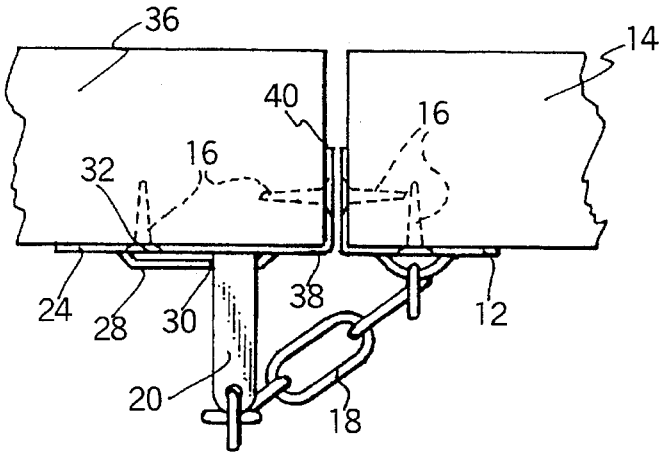
FIG. 2
FIG. 3
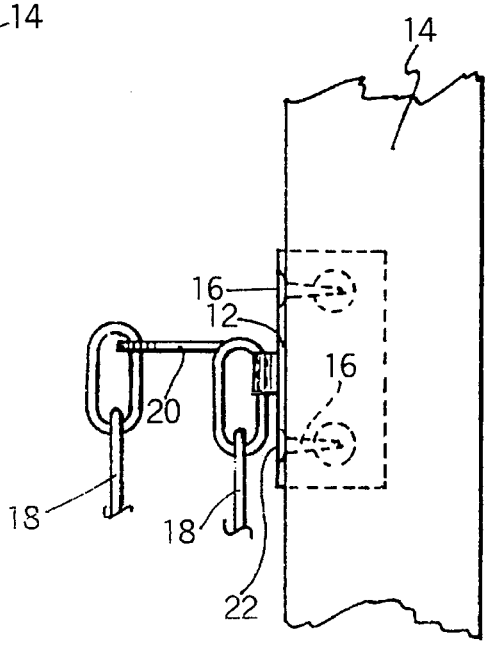

CHAIN LOCK FOR TRAILER DOORS OR MOBILE HOME DOORS

BACKGROUND OF THE INVENTION

1. Field of the Invention

This invention is related to a closure means for trailer doors. More specifically, this invention provides a chain lock for trailer doors or mobile home doors.

2. Description of Prior Art

U.S. Pat. No. 3,809,418 by Canfield discloses a chain-type door fastening device mounted on the door jamb and integrated into the strike plate assembly of the conventional door knob and latch. U.S. Pat. No. 3,936,085 by Long discloses a plate that overlies the edge of the door jamb; a second plate attached to the door; a chain connecting to the door attached plate and includes a lug that is insertable into a slot in the plate. U.S. Pat. No. 4,027,908 by Crepinsek teaches a lock comprising a pair of plates, one attaching to and overlying a door jamb and the other attaching to the door behind the usual tumbler lock and overlying a portion of the edge of the door. A chain attaches to the jamb mounted portion of the lock and a lug is inserted into a slot on the portion of the lock attached behind the lock cylinder.

SUMMARY OF THE INVENTION

It is an object of this invention to provide a closure means for trailer doors or mobile home doors.

It is another object of this invention to provide a novel chain lock for trailer doors or mobile home doors that is economically manufactured and is easily used.

Broadly, this invention provides a chain lock for trailer doors or mobile home doors comprising a first mounting member; a chain member pivotally attached to the first mounting member; and a locking member pivotally connected to the other end of the chain member. The locking member includes a solid flat member. A second mounting member is included with a structure defining a plurality of apertures, at least one of the apertures being essentially rectangular. A lug means overlays the rectangular aperture to form an eye. The lug means has a structure of a constant depth throughout its length and a generally elongated rectangular shape with respect to a top plan view. The rectangular shape being essentially symmetrical such as when the solid flat member is inserted into the eye is snugly engaged within the eye so as not to be tiltable to more than a very slight degree. This has been found to prevent unlocking through a partially opened door by jiggling members of the lock, for example, the chain.

These foregoing objects with the various ancillary objects and features which will become apparent as the following description proceeds, are attained by this chain lock, preferred embodiments being shown in the accompanying drawings, by way of example only, wherein:

BRIEF DESCRIPTION OF THE DRAWINGS

FIG. 1 is a front elevational view of an embodiment of the chain lock attached to a door and behind the casement of a wall;

FIG. 2 is a top plan view of the invention; and

FIG. 3 is a side elevational view of the chain lock.

DETAILED DESCRIPTION OF THE INVENTION

Referring now to the drawings, wherein like reference numerals designate similar parts throughout the various views, there is seen a chain lock, generally illustrated as 10, having a mounting member 12 mounted behind the casement of a trailer or mobile home wall 14 by screws 16. A chain member 18 is pivotally attached to the mounting member 12, and a locking member 20, having a solid flat member 22, is pivotally connected to the other end of the chain member 18. An L-shaped mounting member 24, having a plurality of apertures 26 with fastener means 16 inserted into said aperture 26 for attaching to a door 36, has a lug means 28 interposed thereon to form an eye 30. Lug means 28 has a structure of a constant depth throughout its length and a generally elongated rectangular shape (as seen in FIG. 1 and FIG.2) with respect to a top plan view. This shape is essentially symmetrical such as when the solid flat member 22 is inserted into the eye 30, side 32 of the flat member is snugly engaged within the eye 30 as is the opposite side 34 of the flat member 22, and both in snug slidable engagement therewith. Mounting member 12 also has a plurality of apertures 26 wherein screws 16 (or any other fastener means) are inserted for securing to the casement 14. L-shaped mounting member 24 has a leg 38 overlaying the edge of door 36 and another leg 40 overlaying the inside surface of the door 36 adjacent the edge thereof.

It has been discovered that an advantageous feature of this invention is having sides 32 and 34 of flat member 22 snugly engaged within eye 30. This feature along with the constant and relative long depth of 22 relative 28 enables the chain lock 10 to function and protect against tampering and release by jiggling chain 18 through a partially open door. I have found for best results, that the depth of 22 should be twice that of 28 at least.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth herein.

I claim:

1. A chain lock for trailer doors or mobile home doors comprising a first mounting member; a chain member pivotally attached to said first mounting member, a locking member pivotally connected to the other end of said chain member, said locking member including a solid flat member; a second mounting member having a structure defining a plurality of aperture a lug means interposed on said second mounting member to form an eye, said lug means having a structure of a constant depth throughout its length, said being no greater than one-half the depth of said solid flat member and a generally elongated rectangular shape with respect to a top plan view and essentially horizontal with respect to a horizontal plane, said shape being essentially symmetrical such that when said solid flat member is inserted into said eye, the sides of said flat member are snugly yet slidably engaged within said eye, said first mounting member has a structure defining a plurality of opening, fastener means inserting into said openings for securing said first mounting member behind a casement of a trailer wall or mobile home wall, said second mounting member is generally L-shaped, fastener means inserted into said apertures of said second mounting member to secure same to the edge of a trailer door or mobile home door such as to have one leg of said L-shaped mounting member overlaying the edge of the door and the other leg or said L-shaped mounting member overlaying the inside surface of the door adjacent the edge thereof.

* * * * *